United States Patent [19]

Toon et al.

[11] Patent Number: 5,048,605

[45] Date of Patent: Sep. 17, 1991

[54] PACKING-SEAL FOR BOREHOLES

[75] Inventors: Donald A. Toon, Burlington; Peter F. Kuryllowicz; Douglas J. Belshaw, both of Georgetown; John A. Cherry, N2L 5H7; Paul E. Johnson, both of Waterloo, all of Canada

[73] Assignee: University of Waterloo, Waterloo, Canada

[21] Appl. No.: 350,001

[22] PCT Filed: Nov. 9, 1987

[86] PCT No.: PCT/GB87/00796

§ 371 Date: Jul. 11, 1990

§ 102(e) Date: Jul. 11, 1990

[87] PCT Pub. No.: WO88/03597

PCT Pub. Date: May 19, 1988

[30] Foreign Application Priority Data

Nov. 14, 1986 [GB] United Kingdom ..... 8627207

[51] Int. Cl.[5] ..... E21B 33/127

[52] U.S. Cl. ..... 166/187; 166/203; 277/34

[58] Field of Search ..... 166/187, 179, 192, 202, 166/203; 277/34, 34.3, 34.6, 212 R, 212 C, 212 F, 212 FB, 230; 285/925

[56] References Cited

U.S. PATENT DOCUMENTS

| | | | |
|---|---|---|---|
| 2,781,852 | 2/1957 | Rumble | 166/120 |
| 3,085,627 | 4/1963 | Sodich | 166/120 |
| 4,310,161 | 1/1982 | Streich | 277/121 |
| 4,406,461 | 9/1983 | McGill | 166/187 |
| 4,544,165 | 10/1985 | Coone | 277/34 |
| 4,838,079 | 6/1989 | Harris | 73/863.33 |

*Primary Examiner*—Terry L. Melius

*Attorney, Agent, or Firm*—Anthony Asquith & Co.

[57] ABSTRACT

The packing-seal is shown in use in a borehole as a level-isolating seal for a groundwater sampler. The packing-seal shown includes an expandable annulus of Dowell (TM) water-expandable material. Surrounding that is a pressure-sleeve of rubber. A sheet of woven Kevlar (TM) is wrapped circumferentially around the sleeve and the Dowell annulus, such that the ends of the Kevlar sheet overlap. Outside the Kevlar is an outer rubber sleeve. Upon expansion of the packing seal to fill the borehole, the Kevlar sheet unwraps to allow the Dowell to expand without restraint. Once the packing seal has filled the borehole, the Kevlar sheet is prevented from unwrapping further. If the borehole contains a fissure the Kevlar provides a rigid bridge over the fissure, and prevents the packing-seal from ballooning out into the fissure.

12 Claims, 3 Drawing Sheets

PACKING-SEAL FOR BOREHOLES

This invention relates to packing-seals, of the kind that are used to isolate the various levels in a borehole. The boreholes in question are made in the ground, for example for the purpose of testing for contaminants that may be present in groundwater.

The general construction of such packing-seals, for use in a groundwater sampler, may be described as follows. The sampler itself includes a tube of PVC or other suitable material which is placed in the borehole. The tube contains one or several sampling ports, which are set at predetermined depths in the borehole.

Each sampling port is sealed off from the remainder of the borehole by respective packing seals, placed above and below the sampling port. The (vertical) distance apart of the packing-seals may range from a few centimeters to several meters.

Such packing seals have the requirement to be able to expand. When the tube is being lowered into the hole, the packing-seal must be clear of the walls of the borehole, whereas, once the packing-seal is in position at the correct depth, the packing-seal must expand into intimate sealing contact with the borehole wall.

In order that the packing-seal may be expandable, conventional packing-seals have been inflatable from ground level, or have been based on the use of a material, for example bentonite or Dowell Chemical Seal Ring Gasket (Trademark), which expands considerably when soaked in water.

Packing-seals may or may not be designed to be retrievable from the borehole.

Attention is now directed to the manner in which a packing-seal cooperates with the borehole. The borehole is drilled into the ground that is being sampled. It is normally the case that the type of ground from which the samples are to be taken is the kind that includes several different stratas, and various minor faults and pockets, because that is the kind of ground that is most apt to lead to the spreading of contaminants in the groundwater. Under these conditions, the packing-seal therefore is required to seal against what may be a very imperfect borehole-wall surface.

The requirements of the seal to provide a complete and reliable constraint against leakage of groundwater past the seal, on the other hand, are quite stringent. If the seal leaks, there is often no way of discovering the fact that the leak has occurred. The sampler apparatus continues to allow a sample of the water to be taken at the sampling port, and the analyst has no way of knowing that the water in the sample may have leaked in from a different depth.

This invention is aimed at providing, without undue expense, a packing-seal in which the analyst may have a high degree of confidence that the packing-seal is actually sealing, even though the analyst knows that the borehole wall surface may be imperfect due to fissures, faults, pockets, minor cave-ins, non-cohesive material, and the like, in the borehole wall.

Turning now to the physical construction of the packing-seal, hitherto. When the packing-seal has been of the kind that uses a water-expandable substance, such as bentonite, the bentonite is contained in the annular space between the PVC tube and a rubber sleeve. The rubber sleeve is secured to the PVC tube above and below the bentonite by means of clamps or end-grips. Between the end-grips, the PVC tube is provided with slots or holes so that the interior of the tube can communicate with the bentonite. Once the packing-seal is located in position, water is fed into the PVC tube from the surface, and this water flows out through the slots into contact with the bentonite, which consequently expands. The potentially-contaminated water that is to be sampled in the borehole must of course be kept sealed and separated from this water from the surface.

Bentonite, and other water-expandable materials, expand with a considerable force. If the borehole wall surface is strong, the bentonite is contained, and will be restrained from further expansion. But if the wall surface is locally very weak, or not present, the bentonite will continue to expand, with only the rubber sleeve to contain it.

If the rubber sleeve is very thin, the bentonite may burst the sleeve, causing the packing-seal to leak, and, as explained, the analyst might not be aware that this had happened. On the other hand, if the rubber is thick and strong, then even if the bentonite can expand to some degree against the resistance of the rubber, the sleeve will not be able to conform to minor irregularities in the wall surface, and again the seal may leak.

Thus, if the rubber sleeve is too thin, the sleeve may burst if it expands into a fissure, and will leak. If the sleeve is too thick, the sleeve will not conform sufficiently to minor irregularities, and again will leak. This compromise over the properties of the packing-seal has meant that samples taken from boreholes with imperfect surfaces, using conventional sampling apparatus, have been unacceptably unreliable.

It may be noted that this problem occurs whether the packing-seal is of the water-expandable kind, or of the gas-inflatable kind. For the purposes of this specification, in both cases the packing-seal includes what may be termed an expandable annulus.

GENERAL DESCIPTION OF THE INVENTION

It is recognized in the invention that this compromise over the requirements of the material of the sleeve cannot satisfactorily be met by rubber on its own.

The invention consists in providing a supplementary containment sleeve, outside the expandable annulus, in addition to the rubber sleeve.

In the invention, the supplementary containment sleeve is made of a material that has a substantially greater inherent rigidity than rubber. A stiff fabric is an example of such a material.

However, in the invention, the supplementary containment sleeve is so constructed that, on its own and without support, the supplementary containment sleeve has substantially no resistance to circumferential expansion; and, in the invention, this inherent lack of resistance to circumferential expansion arises by virtue of the shape of the supplementary containment sleeve.

An example of how the material may be so shaped as to permit circumferential expansion is that the material may be in the form of a sheet, which is wrapped around the expandable annulus. The size of the sheet preferably is large enough to provide a substantial circumferential overlap. As the expandable annulus expands, the supplementary containment sleeve can accommodate that expansion simply by unwrapping to the required extent.

The supplementary containment sleeve continues to unwrap until the expansion is enough to allow the packing-seal to make sealing contact with the borehole wall. At this point, the supplementary containment sleeve is supported and constrained by the borehole wall against further expansion, with the result that the supplementary containment sleeve now "freezes"—i.e., its rigidity in the circumferential sense increases sharply —as the unwrapping mode of movement is suddenly prevented.

The more the expandable annulus tries to expand from then on, the more the supplementary containment sleeve is restrained by its operative engagement with the borehole wall. This engagement forces the overlapped ends of the sleeve tightly together, with the result that the overlapped ends grip each other tightly, thus resisting further circumferential expansion of the containment sleeve.

When and if the borehole wall is incomplete due to the presence of a pocket or fissure, the supplementary containment sleeve acts to constrain the material of the expandable annulus from expanding locally into the fissure. Naturally, there is a limit to the size of fissure that can be accommodated in this way, but it is recognized, in the invention, that a fissure that is several centimeters in vertical height can be accommodated. A fissure larger than that would, in any event, be detected when drilling the borehole, and could therefore be avoided.

The packing-seal of the invention can be of the same overall dimensions as conventional packing-seals, which may be of the order of 50 or 70 cm, for a borehole of 7 or 10 cm diameter.

In the invention, the material from which the supplementary containment sleeve is made is preferably Kevlar (Trademark). In woven fabric form, Kevlar very much has the property required in the invention, of being able to unwrap virtually without resistance, but of being very stiff and rigid against local distortions.

Woven fabrics are not, as a general rule, waterproof, and woven Kevlar is not waterproof. The fact that the Kevlar will not itself contain water leads to two factors which the designer should bear in mind when designing the packing-seal. First, the designer should of course see to it that there is no leakpath through the woven material between the inside and the outside of the tube.

The second factor is as follows. The means by which the packing-seal expands may be one of a number of different means; but the aspect that is common to all the means is that there is a pressure created inside the packing seal. This pressure, whether it is generated pneumatically, or hydraulically, must be contained. Even when the means for expansion is an expandable material, as described, such as Dowell or Bentonite, it is necessary to supply water to the material to expand it, and it is generally necessary to supply the water under pressure.

Since the woven Kevlar cannot contain this pressure, it is, as a rule, necessary to fit a rubber pressure-sleeve between the Kevlar supplementary containment sleeve and the pressurised medium. This rubber pressure-sleeve should be placed inside the Kevlar—if the pressure-sleeve were placed outside the Kevlar, and if the pressure were then to leak through the Kevlar, the pressure would simply cause such an outside pressure-sleeve to expand away from the Kevlar.

On the other hand, the main purpose of the the packing-seal of course is to provide a watertight seal to the walls of the borehole, so the designer should see to it that there is a further sealing means between the Kevlar and the borehole walls.

It is therefore preferred, in the invention, when the material of the supplementary containment sleeve is Kevlar, also to fit a second rubber sleeve outside the Kevlar, in addition to the rubber pressure-sleeve placed inside the Kevlar. Thus, in the invention, when a Kevlar wrap-around sleeve is provided, the sleeve preferably is sandwiched between two rubber sleeves.

BRIEF DESCRIPTION OF DRAWINGS

In order to further illustrate the invention, examples of packing-seals which incorporate the invention will now be described, with reference to the accompanying drawings, in which.

DETAILED DESCRIPTION OF PREFERRED EMBODIMENTS

Figure 1:
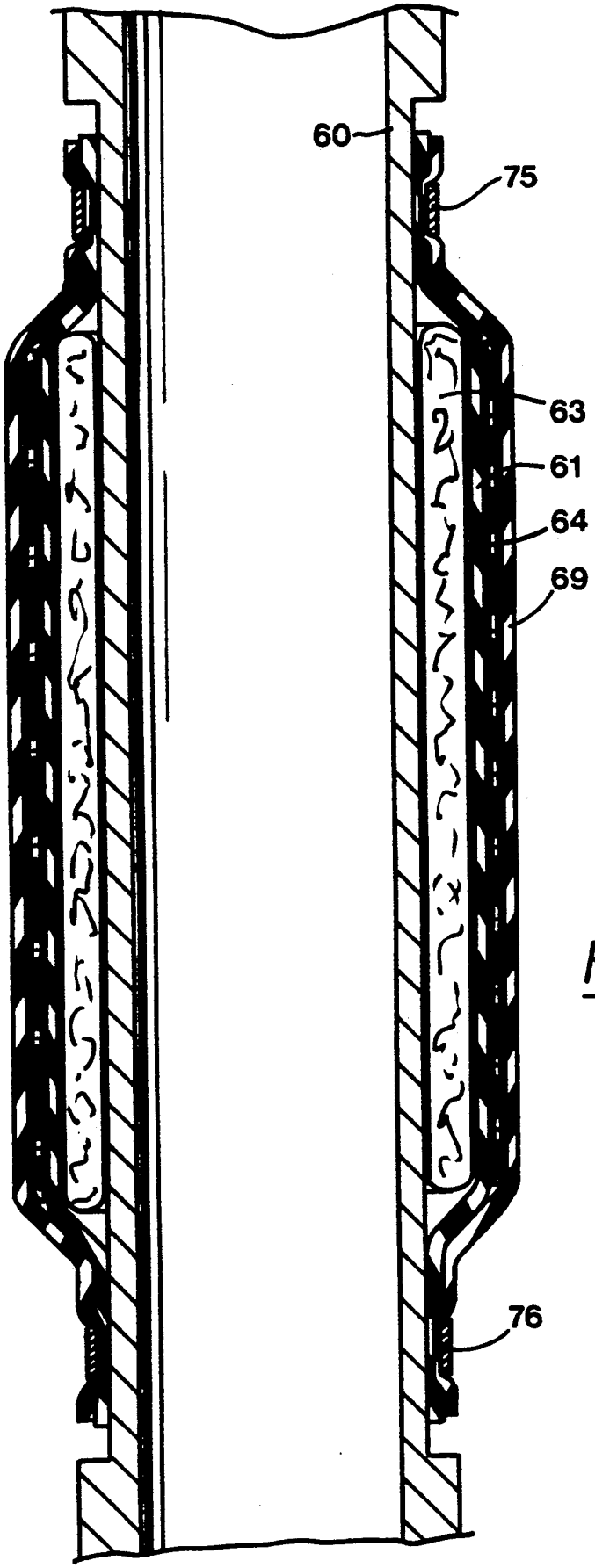
FIG. 1 is a cross-section of an exemplary packing-seal.
Figure 3:
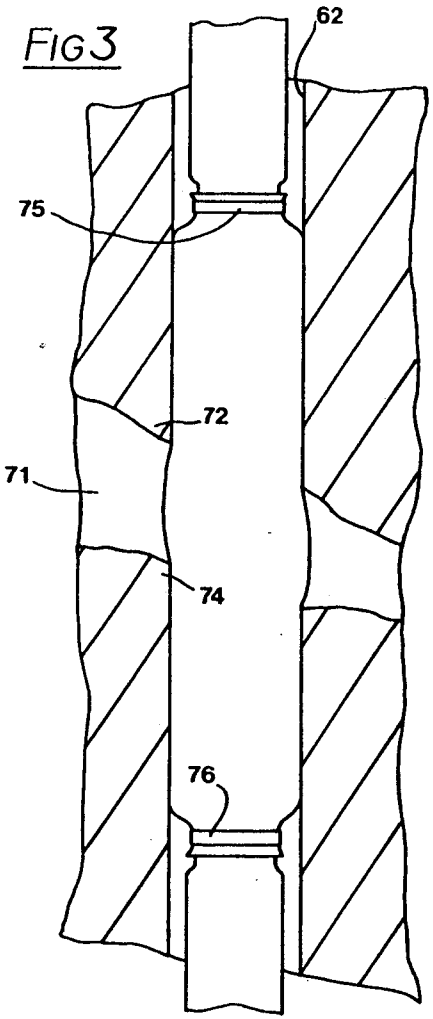
FIG. 3 shows the packing-seal of FIG. 1 in use in a borehole.
Figure 2:
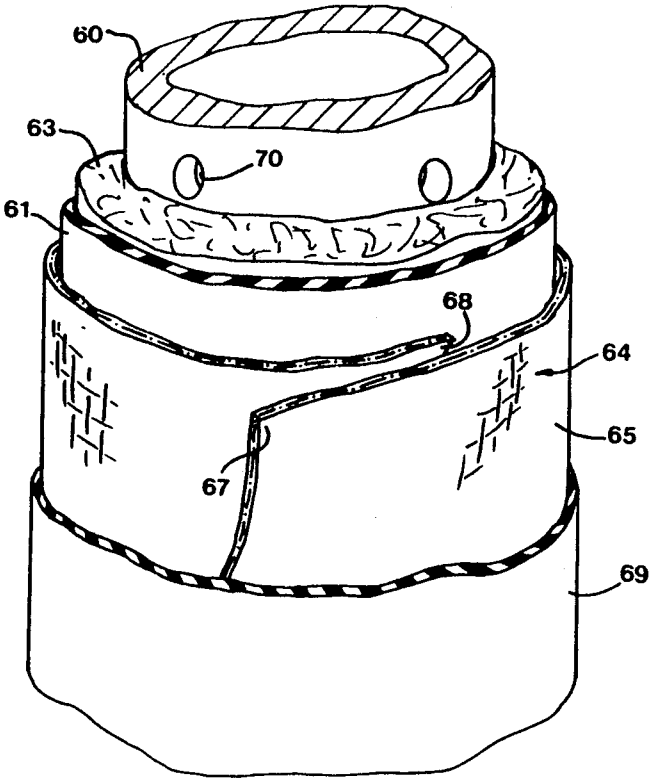
FIG. 2 is a partly-cutaway view of the packing-seal of FIG. 1, showing a detail of construction.

A portion of a groundwater sampler is shown in FIG. 1. The sampler includes a PVC tube 60, which extends down into a borehole. The borehole has a wall-surface 62 (FIG. 3).

Surrounding the tube 60 is an expandable annulus 63, which is made of Dowell Chemical Seal Ring Gasket (Trademark) water-expandable material. Alternatively, the material of the annulus could be bentonite, or the annulus 63 could be of the kind that includes a bag which is inflated by air or gas pressure from the surface.

Surrounding the Dowell 63 is a pressure sleeve 61, and surrounding that in turn is a supplementary containment sleeve 64, which comprises a sheet 65 of woven Kevlar material. The dimensions of the sheet are such that there is a substantial circumferential overlap of the lateral ends 67,68 of the sheet 65.

Surrounding the Kevlar in turn is an outer sleeve 69 of rubber. The rubber sleeves 61,69 are in the form of respective closed tubes, as distinct from the wrapped-sheet form of the Kevlar.

The tube 60 is provided with holes or slots 70, by which the Dowell annulus 63 is in communication with the interior of the tube 60. When the sampler is being assembled into the borehole, the interior of the tube 60 is dry, but once the tube 60 is in place in the borehole, the tube is flooded with water from the surface. The water passes out (preferably under pressure) through the holes 70, and into contact with the Dowell annulus 63.

The Dowell 63 consequently expands, which causes the pressure-sleeve 61 and the containment sleeve 64 also to expand. The sleeve 64, as it comprises the wrapped or overlapped sheet 65, can expand readily, to follow the expansion of the Dowell. The outer rubber sleeve 69 is soft enough to have virtually no restraining effect on the expansion of the Dowell 63 and the Kevlar sleeve 64. The pressure-sleeve 61 prevents the outer sleeve from being subjected directly to the internal pressure of the water.

During the expansion of the sleeve 64, the overlapped ends 67,68 of the sheet 65 approach each other. So long as the expansion is unrestrained, there is virtually no friction which could interfere with the relative slippage of the overlapped ends 67,68 of the sheet 65.

Once contact is made between the outer sleeve 69 and the surface 62 of the borehole wall, however, a restraint is placed on the further expansion of the Dowell 63. Forces start to build up in the components of the packing-seal as the Dowell becomes squeezed between the tube 60 and the wall 62. These forces cause the overlapped ends 67,68 to engage together with a heavy frictional force, which effectively sets, or freezes, the Kevlar sheet 65 into a tube, the tube being of the correct diameter to seal perfectly in the hole.

Once this diameter is set, a further tendency towards expansion of the Dowell has the effect not of causing the packing-seal to balloon outwards, but of setting the correct diameter even more firmly.

In the invention, the outer rubber sleeve 69 is not required to contain the expanding Dowell. Therefore, the rubber used in the sleeve 69 can be soft, which means that the material of the sleeve can be highly conformable to any slight irregularities in the borehole wall.

If the borehole 62 contains a fissure 71, this locking or freezing of the Kevlar sheet 65 into a non-expandable tube cannot occur over the immediate extent of the fissure 71. However, the freezing does occur where the borehole is complete, i.e. above 72 and below 74 the fissure 71. So long as the fissure 71 is not too long, i.e. so long as the distance apart of the expansion-resisting parts 72,74 of the borehole wall 62 is not too far, the Kevlar will bridge or straddle the gap, and will prevent the Dowell from ballooning out into the fissure.

It is a feature of the invention that the packing-seal of the invention has the ability to expand easily to fit quite a wide range of borehole diameters, yet once the packing-seal has contacted the borehole wall, the packing-seal freezes, and rigidly resists any further gross distortion of the packing-seal into any fissures that might be present.

The outer sleeve 69 is sealed at the ends by means of end-grip clamps 75,76. Water from the soil must not be allowed to leak into the interior of the tube 1, and the clamps may be of double or triple construction to provide this anti-leak reliability.

Figure 4:
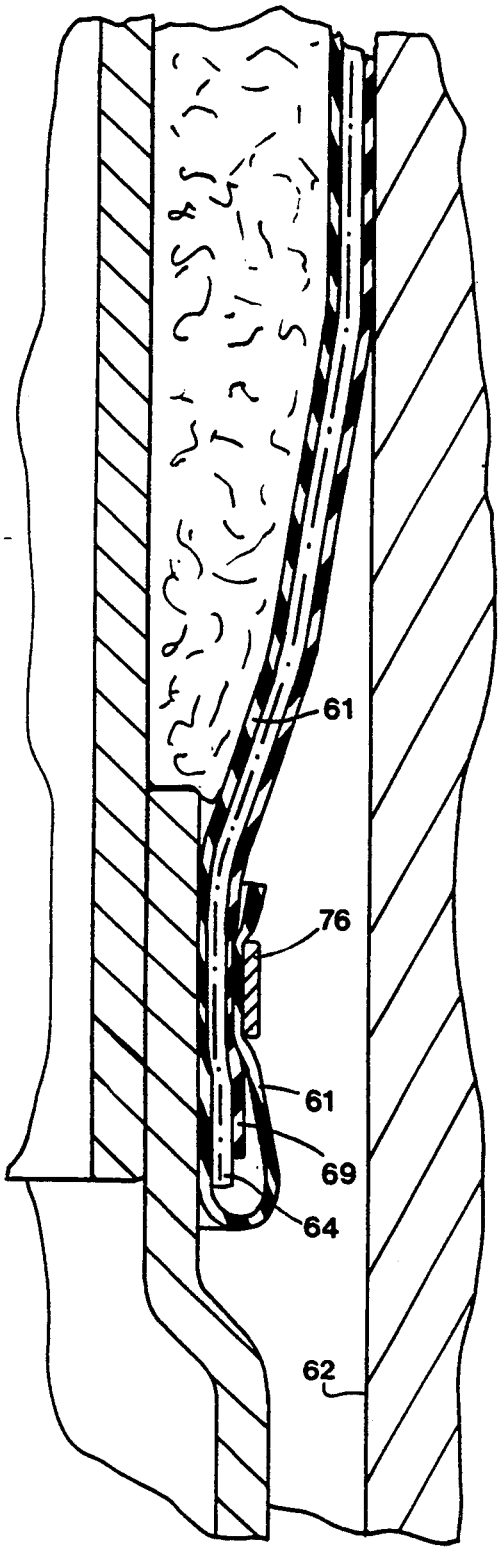
FIGS. 4 and 5 show alternative ways in which the packing-seal may be constructed.

In the alternative construction of the packing-seal shown in FIG. 4, the Kevlar sheet 65 extends through and beyond the end-grip clamp 75. In this arrangement, the inner pressure-sleeve 61 is doubled over and so arranged as to make the ends of the packing-seal watertight.

It may be noted that in the FIG. 4 version the Kevlar in the region of the clamps is always frozen against any circumferential unwrapping because of the clamps, even before the Dowell is expanded. This constraint at the ends of the packing-seal can be useful in preventing the sleeve from ballooning into a fissure that happens to be located right by the clamp.

Figure 5:
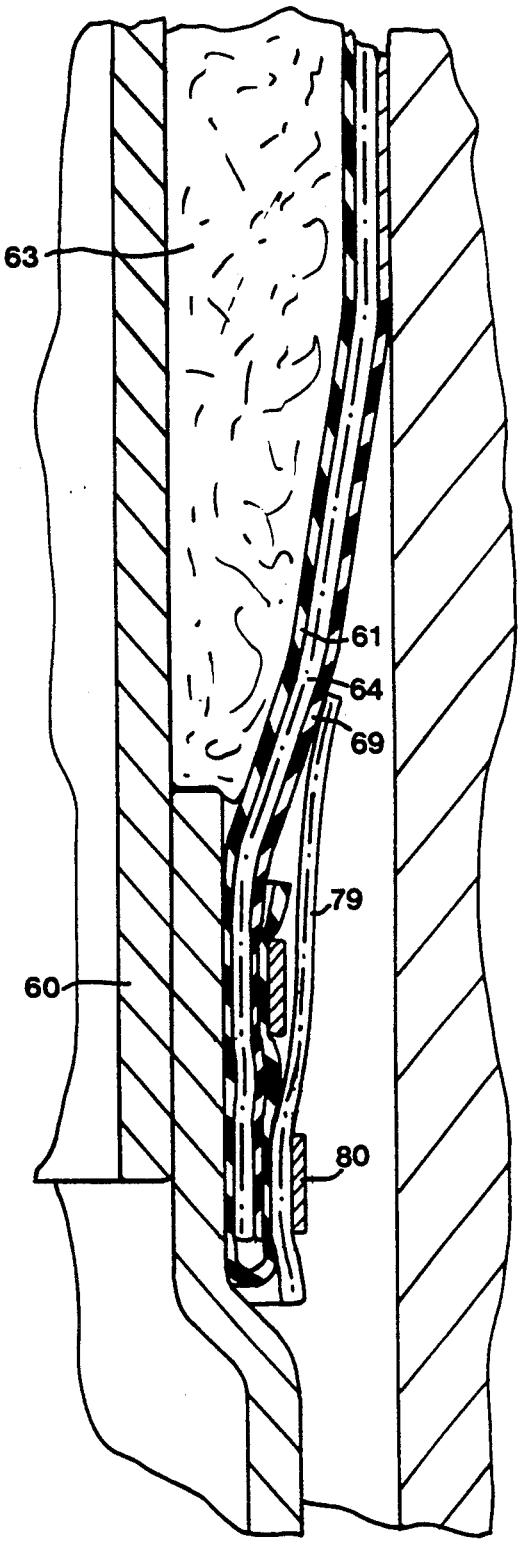

In the further alternative construction shown in FIG. 5, a cuff 79 of Kevlar is incorporated into the packing-seal. The cuff 79 is separate from the Kevlar sheet 65, and is secured by means of the clamp 80 in the manner shown. (It may be thought that the sheet 65 could be doubled over to act as the cuff, but that is not preferred because, in that case, it would be very difficult to make the packing-seal reliably watertight.)

The exposed cuff 79 acts to protect the packing-seal from damage.

A further barrier-sleeve may be included in the packing-seal. The barrier sleeve may be placed immediately outside the inner rubber sleeve 61, and comprises a sheet of plastic sheeting which is wrapped around with its circumferential ends overlapped, in the same manner as the Kevlar sleeve 65. The barrier sleeve thus can expand with the Kevlar sheet.

The purpose of the barrier sleeve may be explained as follows. The rubber material of the sleeves 61,69 is selected mainly for its elastic properties, and its ability to prevent water leaks. The Dowell material 63, however, contains chemical substances which can, over a period of time, migrate through such a rubber material. These substances, if they were to diffuse through the rubber, might be detected falsely as contamination in the sample of groundwater. The barrier sleeve can provide confidence that contamination, if detected, must have been present in the groundwater, and did not come from the Dowell.

We claim:

1. Packing seal assembly for a borehole, wherein:

the assembly includes an expandable annulus, having axial length;

the assembly includes a supplementary containment sleeve, which comprises a sheet of material;

the sheet of material extends around the circumference of the expandable annulus;

the sheet has upper and lower ends, and opposing left and right ends;

the dimensions and arrangement of the sheet and of the expandable annulus are such that the left and right ends of the sheet overlap;

the said material of the sheet is substantially stiff and not stretchable, to the extent that the dimensions of the material remain substantially constant, when the annulus expands;

and the sheet is so arranged in the assembly that, over at least a substantial proportion of the axial length of the annulus, the left and right ends of the sheet are free of constraint, to the extent that the left and right ends are freely slidable in the circumferential sense relative to each other, whereby the circumferential dimension of the supplementary containment sleeve is freely expandable.

2. Assembly of claim 1, wherein:

the expandable annulus is of the kind in which the material of the outer surface of the annulus is stretchable material;

and the sheet is so arranged in the assembly that, over at least a substantial proportion of the axial length of the annulus, the material of the sheet is not constrained as to circumferential movement relative to the expandable annulus, but is free to move and slide circumferentially, substantially without constraint, relative to the annulus.

3. Assembly of claim 1, wherein:

the sleeve comprises only a single sheet of material, and the dimensions of the said single sheet and of the annulus are such that the distance, measured circumferentially, between the said left and right ends of the single sheet is substantially greater than the circumference of the annulus, whereby the said left and right ends are overlapped.

4. Assembly of claim 2, wherein:

the assembly includes an outer sleeve of elastomeric material, which circumferentially surrounds the expandable annulus;

and the elastomeric material of the outer sleeve is inherently soft and pliable, to the extent that the material is substantially incapable of containing the annulus against expansion.

5. Assembly of claim 4, wherein:

the assembly also includes an inner sleeve of elastomeric material;

the said outer sleeve surrounds the supplementary containment sleeve;

the supplementary containment sleeve surrounds the inner sleeve;

and the inner sleeve surrounds the expandable annulus.

6. Assembly of claim 5, wherein:

the assembly includes means for sealing the sleeves against water ingress, the arrangement being such:

that the supplementary containment sleeve is sealed between the inner and outer sleeves against water ingress both from outside and inside the assembly;

and that the expandable annulus is sealed against water ingress from outside the assembly, but is open to water inside the assembly.

7. Assembly of claim 6, wherein:

the assembly includes upper and lower end grip clamps;

and the end grip clamps are effective to seal the respective upper and lower ends of both the inner and outer sleeves against water ingress.

8. Assembly of claim 7, wherein:

one end of one of the inner and outer sleeves is doubled over the corresponding end of the other of those two sleeves;

and the arrangement is such that the end grip clamp at that end is effective to clamp the material of the inner and outer sleeves into direct, sealing, contact with each other.

9. Asembly of claim 1, wherein:

the assembly includes upper and lower sleeve clamps;

the sleeve clamps encircle upper and lower portions of the supplementary containment sleeve, and are effective to constrain the supplementary containment sleeve in the said portions against circumferential expansion;

whereby the said left and right ends of the sheet are free of the said circumferential constraint only over an intermediate portion of the supplementary containment sleeve, between the two clamps.

10. Assembly of claim 1, wherein:

the material of the supplementary containment sleeve is strong and rigid, to the extent that the material, when supported against circumferential expansion over a portion of its area, is, in substance, able to contain the annulus against circumferential expansion over the remainder of its area;

and the material of the supplementary containment sleeve is so shaped and disposed that the supplementary containment sleeve, on its own and without support, has substantially no resistance to circumferential expansion.

11. Assembly of claim 10, wherein:

the said material of the supplementary containment sleeve is woven Kevlar (Trademark).

12. Assembly of claim 1, wherein:

the assembly is suitable for use, in conjunction with a sample tube, to seal the tube to the wall surface of a borehole formed in the ground.

* * * * *